US009373279B2

(12) United States Patent
Lowles

(10) Patent No.: US 9,373,279 B2
(45) Date of Patent: Jun. 21, 2016

(54) METHOD AND SYSTEM FOR PROVIDING A SCREEN SAVER IN A MOBILE ELECTRONIC DEVICE

(75) Inventor: Robert J. Lowles, Waterloo (CA)

(73) Assignee: BlackBerry Limited, Waterloo (CA)

( * ) Notice: Subject to any disclaimer, the term of this patent is extended or adjusted under 35 U.S.C. 154(b) by 1668 days.

(21) Appl. No.: 12/172,480

(22) Filed: Jul. 14, 2008

(65) Prior Publication Data

US 2008/0276204 A1 Nov. 6, 2008

Related U.S. Application Data

(63) Continuation of application No. 10/663,590, filed on Sep. 16, 2003, now abandoned.

(51) Int. Cl.

| | |
|---|---|
| ***G09G 3/22*** | (2006.01) |
| ***G09G 3/32*** | (2016.01) |
| ***G09G 5/02*** | (2006.01) |
| ***G09G 5/04*** | (2006.01) |
| ***G09G 5/06*** | (2006.01) |

(52) U.S. Cl.

CPC ..... *G09G 3/3208* (2013.01); *G09G 3/3216* (2013.01); *G09G 5/02* (2013.01); *G09G 5/024* (2013.01); *G09G 5/04* (2013.01); *G09G 5/06* (2013.01); *G09G 3/22* (2013.01); *G09G 2320/046* (2013.01); *G09G 2330/022* (2013.01)

(58) Field of Classification Search

CPC ..... G09G 5/02; G09G 5/04; G09G 5/06; G09G 5/024; G09G 3/3208

USPC ..... 715/526, 864, 867; 345/76, 82–83, 901, 345/77, 204

See application file for complete search history.

(56) References Cited

U.S. PATENT DOCUMENTS

| | | | | |
|---|---|---|---|---|
| 4,922,328 | A | 5/1990 | Engel et al. | |
| 5,211,463 | A | 5/1993 | Kalmanash | |
| 6,535,196 | B2 * | 3/2003 | Walker et al. | 345/102 |
| 6,621,488 | B1 * | 9/2003 | Takeuchi et al. | 345/204 |
| 7,038,668 | B2 * | 5/2006 | Kota et al. | 345/204 |
| 7,042,427 | B2 | 5/2006 | Inukai | |
| 7,123,221 | B2 | 10/2006 | Yamada | |
| 7,196,701 | B2 * | 3/2007 | Tsutsui et al. | 345/211 |
| 7,205,961 | B1 * | 4/2007 | Yashiro et al. | 345/60 |
| 2002/0044143 | A1 | 4/2002 | Kota et al. | |
| 2002/0095222 | A1 | 7/2002 | Lignoul | |
| 2002/0101395 | A1 | 8/2002 | Inukai | |
| 2003/0117382 | A1 * | 6/2003 | Pawlowski et al. | 345/204 |
| 2003/0169306 | A1 | 9/2003 | Makipaa et al. | |

FOREIGN PATENT DOCUMENTS

| | | |
|---|---|---|
| DE | 101 13 248 | 10/2002 |
| WO | 97/17827 | 5/1997 |

* cited by examiner

*Primary Examiner* — Amy Ng
*Assistant Examiner* — Sajeda Muhebbullah
(74) *Attorney, Agent, or Firm* — Borden, Ladner, Gervais, LLP; Geoffrey Dekleine

(57) ABSTRACT

A system and method for providing a screen saver for a display panel in a mobile electronic device are provided. After a time period of inactivity has been sensed, a screen saver image is retrieved from memory and transmitted to a display panel. The method and system also preferably provide means for controlling the color of the screen saver image to balance the aging of the primary colors within the display panel.

7 Claims, 3 Drawing Sheets

METHOD AND SYSTEM FOR PROVIDING A SCREEN SAVER IN A MOBILE ELECTRONIC DEVICE

FIELD OF THE INVENTION

The present invention relates generally to mobile electronic devices. More particularly, the present invention relates to a method and system for providing a screen saver in a mobile electronic device.

BACKGROUND OF THE INVENTION

Cathode Ray Tube (CRT) displays suffer from an effect called burn-in. If the same image is left on the CRT for an extended period of time, the phosphor being addressed ages faster than the phosphor not being addressed. The effect of this burn-in is apparent when the CRT is no longer powered, yet an image is still visible. Screen savers or timeouts are generally used to prevent burn-in. Newer display technology such as Organic Light Emitting Diodes (OLEDs) have a similar problem. In the case of OLED panels, or displays, the luminance of the panel decreases over the life of the panel, which is significantly shorter than other display technologies. Another problem with OLED panels is that the life of each primary colour is significantly different. Over time, compensation for the different aging rates of the primary colours is required. Yet another concern with OLED panels is their large power consumption.

Traditional screen savers address these problems, but place a burden on the processor executing the software for the screen saver. Another drawback of the traditional software implementation of a screen saver is the higher on time of the processor, which affects the life of the battery powering the mobile electronic device.

SUMMARY OF THE INVENTION

According to an aspect of the invention, a system for providing a screen saver for a display panel in a mobile electronic device comprises memory for storing a screen saver image, display controlling means configured to retrieve said screen saver image from said memory and to transmit said screen saver image to said display panel during a screen saver mode, and screen saver controlling means for sensing activity by a CPU interface, for switching operation of said display panel from an operating mode to the screen saver mode after a predetermined time period of inactivity by the CPU interface, and for controlling primary colours of said display panel to balance life of said primary colours of said display panel.

In accordance with another aspect of the invention, a method of providing a screen saver for a display panel in a mobile electronic device comprises the steps of sensing a time period of inactivity, transmitting a signal to a display controller indicating said sensing of said time period of inactivity, retrieving a screen saver image from memory, determining a display location of said screen saver image on said display panel, displaying said screen saver image on said display panel at said display location, monitoring use of display panel primary colours, and disabling said primary colours such that colours are preserved.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, a method and system for providing a screen saver in a mobile electronic device are described. The screen saver is implemented via hardware within the mobile electronic device so that there is less burden on a device processor and the life of a battery or other limited power supply typically used in such devices may be extended. Furthermore, in one embodiment, the screen saver provides a colour aging control to preserve the colours of the mobile electronic device panel, or display.

Figure 1:
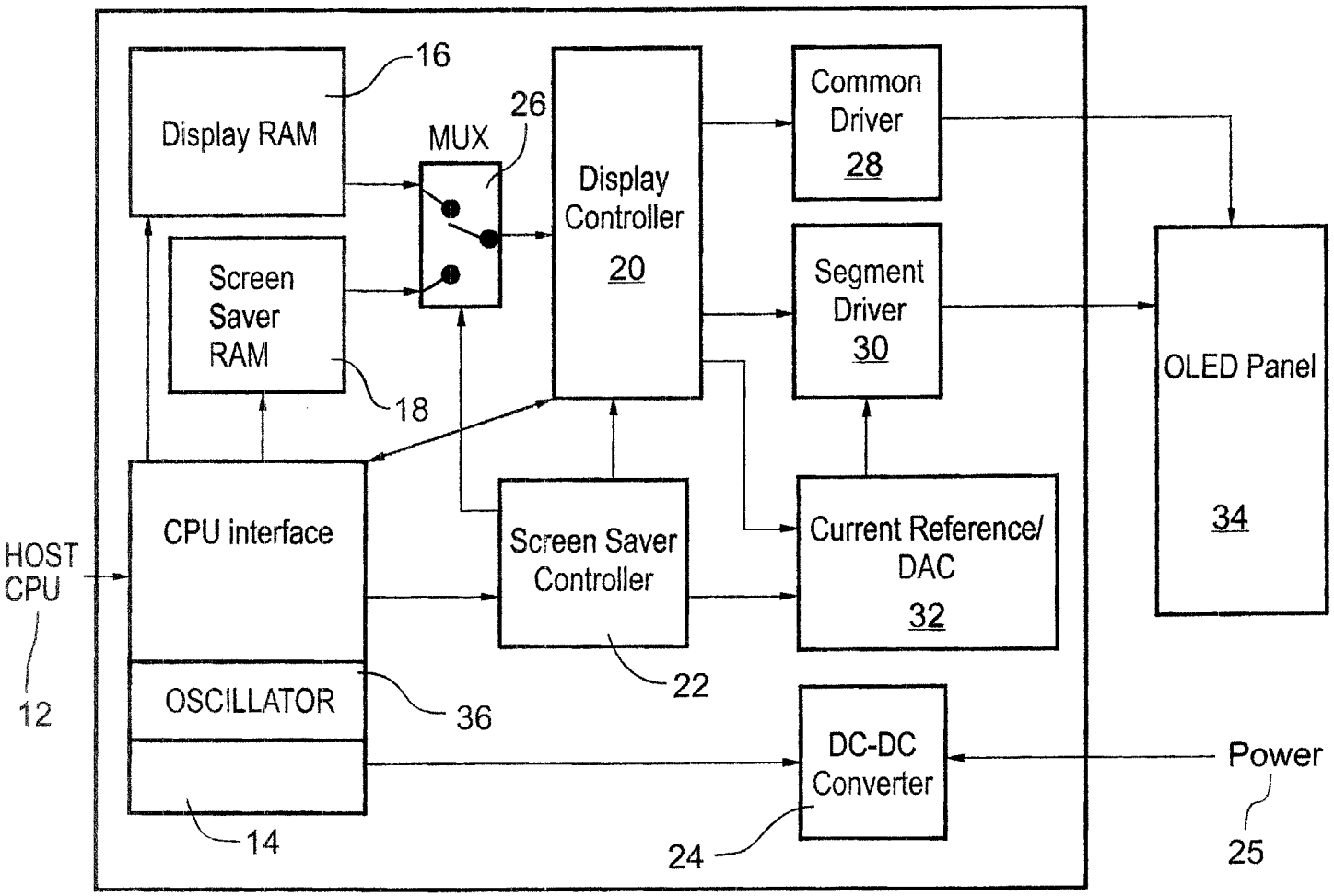
FIG. 1 is a block diagram of an Organic Light Emitting Diode (OLED) driver.

Turning to FIG. 1, a diagram illustrating a single integrated circuit (IC) implementation of an Organic Light Emitting Diode (OLED) driver is shown. The driver 10 is connected to a host central processing unit (CPU) 12 via a CPU interface 14. The CPU interface 14 is connected to a display random access memory (RAM) 16, a screen saver RAM 18, a display controller 20, a screen saver controller 22 and a DC-DC converter 24 which, in turn, is connected to a power source 25, generally in the form of a battery. The interface 14 also includes an oscillator 36 to provide timing for the driver 10.

The display RAM 16, the screen saver RAM 18 and the screen saver controller 22 are connected to a multiplexer (MUX) 26 which is connected to the display controller 20. The display controller 20 is connected to a common driver 28, a segment driver 30 and a current reference/digital-to-analog converter (DAC) 32. The combination of the display controller 20, the common driver 28 and the segment driver 30 may be seen as display controlling means for controlling the screen saver. The screen saver controller 22 is also connected to the display controller 20 and the current reference/DAC 32 while the current reference/DAC 32 is connected to the segment driver 30. Both the common driver 28 and the segment driver 30 are connected to an Organic Light Emitting Diode (OLED) panel 34.

The CPU interface 14 provides an interface between the driver 10 and the host CPU 12 and defines the timing of generic interface signals such as READ, WRITE, CHIP SELECT, ADDRESS LINE(S), DATA LINES, and RESET. The display RAM 16 is preferably SRAM and is used to store an image which is displayed on the OLED panel 34 during an operating mode. In operation, the CPU interface 14 loads the display RAM 16 based on data received from the host CPU 12. The screen saver RAM 18 is functionally similar to the display RAM 16 but has limited memory to store a screen saver image from the host CPU 12. For example, the screen saver RAM 18 may only hold data for a 20.times.20 pixel area even though the pixel area of the panel may be a 220.times.176 pixel area.

The MUX 26 is a switch that selects the source of the image data to be displayed on the OLED panel 34. Therefore, in the operating mode, the MUX 26 provides a connection between the display RAM 16 and the display controller 20 for image retrieval while in a screen saver mode, the MUX 26 provides a connection between the screen saver RAM 18 and the display controller 20 for image retrieval.

The display controller 20 reads the display image data from the display RAM 16 or the screen saver RAM 18 (depending on its connection via the MUX 26) one row at a time and displays the data and provides the timing for the row of image data to be displayed on the OLED panel 34. The display controller 20 then retrieves the next row of image data stored in the display RAM 16 or screen save RAM 18, depending on which mode the OLED panel 34 is in. This process is repeated several times per second until the entire image is displayed on the panel 34. The display controller 20 also defines where the display image data from the display RAM 16 or screen saver RAM 18 is mapped onto the OLED panel 34. For example, the host CPU 12 may transmit a command to the display controller 20 to only display the first fifty lines of image data and leave the rest of the panel 34 blank, or black.

The screen saver controller 22 is used to control the screen saver so that the host CPU 12 does not have as much of a burden. The screen saver controller 22 also controls the MUX 26 as will be described below with respect to FIG. 2 which is a schematic diagram of the screen saver controller 22.

The common driver 28 sends pulses to indicate to the OLED panel 34 the address to which the segment driver 30 is currently sending the image data. Furthermore, the segment driver 30 converts the digital data from the display RAM 16 or screen saver RAM 18 to a current level required to drive the OLED panel 34 at a defined level (pixel luminance). The display RAM 16, via the display controller 20, defines this pixel luminance level and transmits this level to the current reference/DAC 32. The current reference/DAC 32 typically includes a DAC for each of red, green, and blue for a colour display. The DC-DC converter 24 converts the power supply voltage 25, typically 3 V, to a level required by the OLED panel 34.

Figure 2:
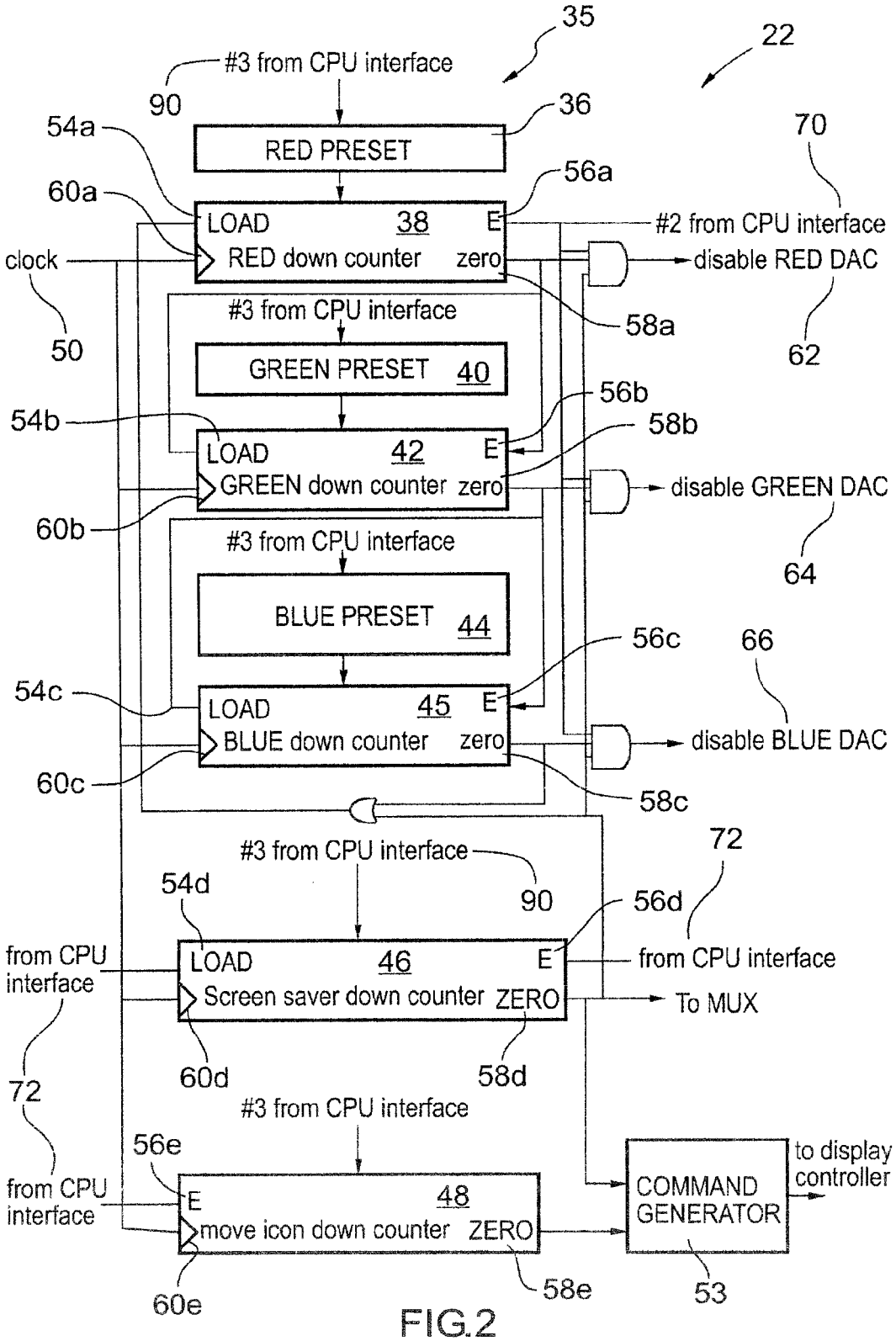
FIG. 2 is a block diagram of a screen saver controller.

Turning to FIG. 2, a schematic block diagram of the screen saver controller 22 is shown. The screen saver controller 22 comprises a set of RGB timers 35 seen as a RED timer comprising a RED preset 36 and a RED down counter 38, a GREEN timer comprising a GREEN preset 40 and a GREEN down counter 42 and a BLUE timer comprising a BLUE preset 44 and a BLUE down counter 45. The screen saver controller 22 also includes a screen saver timer comprising a screen saver down counter 46 and a move icon timer comprising a move icon down counter 48, along with various AND and OR gates. The move icon down counter 48 is also connected to a command generator 53 which is connected to the display controller 20. The move icon down counter 48 provides a timer for determining when the location of the screen saver image is to change.

Inputs to the screen saver controller 22 include a clock source 50 originating from the oscillator 36 in the CPU interface 14 and inputs 70, 72 and 90 from the CPU interface 14.

The command generator 53 generates and transmits two types of commands for the display controller 20. These two commands are image size and start address (image location). The generated start address of the image display is randomly changed each time the move icon down counter 48 reaches zero so that the screen saver image is constantly moving on the OLED panel 34 in order to preserve the primary colours. The image size that is generated and transmitted by the command generator 53 is based on the size of the screen saver RAM 18 or may be determined to be a smaller size by the command generator 53. In a preferred embodiment, the image size for the screen saver is a 20.times.20 pixel area.

Each of the RGB timers is used to control one of the primary colours of the OLED panel 34, to compensate for differential aging of the colours, and is loaded based on values received from the host CPU 12 via the CPU interface 14. Each of the down counters includes a load input 54, an enable input 56, a zero output 58 and a clock input 60. The clock input 60 of each down counter 38, 42, and 45 receives its input from the clock source 50.

The enable input 56*a* of the RED down counter 38 receives the input 70 from the CPU interface 14 while the zero output 58*a* of the RED down counter 38 is connected to the enable input 56*b* and the load input 54*b* of the GREEN down counter 42. The zero output 58*b* of the GREEN down counter 42 is connected to the load input 54*c* and the enable input 56*c* of the BLUE down counter 45. The load input 54*a* of the RED down counter 38 is loaded with the result from the ORing of the zero output 58*c* of the BLUE down counter 45 and the zero output 58*d* of the screen saver down counter 46.

The result of ANDing the input 70 from the CPU interface 14, the zero output 58*a* of the RED down counter 38 and the zero output 58*d* of the screen saver down counter 46 controls a disable RED DAC signal 62 while the result of ANDing the input 70 from the CPU interface 14, the zero output 58*b* of the GREEN down counter 42 and the zero output 58*d* controls a disable GREEN DAC signal 64 and the result of ANDing the input 70 from the CPU interface 14, the zero output 58*c* of the BLUE down counter 45 and the zero output 58*d* of the screen saver time out 46 controls a disable BLUE DAC signal 66. As described above, the current reference/DAC 32 comprises red, green, and blue DACs.

The load input 54*d* and the enable input 56*d* for the screen saver down counter 46, along with the enable input 56*e* of the move icon down counter 48 receive their input from input 72 transmitted by the CPU interface 14.

The zero output 58*d* of the screen saver down counter 46 is connected to the MUX 26 and the command generator 53. The zero output 58*e* of the move icon down counter 48 is also connected to the command generator 53.

In operation, the mobile electronic device OLED panel 34 generally is in one of two operating modes. Mode 1 may be defined the operating mode for the panel whereby the user is interacting with the mobile electronic device while mode 2 is the screen saver mode. As will be understood by one skilled in the art, in mode 1, the host CPU 12 accesses and changes the image data stored in RAM 16 as required by a software application executing on the host CPU 12 of the mobile electronic device. After receiving a signal from the CPU interface 14, the display controller 20 retrieves a row of image data via the MUX 26 (which connects the display controller 20 to the display RAM 16 in mode 1) and transmits a row of the image data to the segment driver 30. After determining the location on the panel for the image data and receiving a pulse from the common driver 28, the segment driver 30 then transmits the row of image data to the OLED panel 34. This process is repeated for each row of the image and continues to be repeated to maintain the image on the OLED panel 34. Once the image has been displayed on the panel, the CPU interface 14 initiates the screen saver down counter 46 by transmitting a signal to the load input 54*d* of the screen saver down counter 46. This value is loaded into the screen saver down counter 46 any time there is activity on the CPU interface 14 or if a row of image data from the display RAM 16 is transmitted to the OLED panel 34. This value is decremented after each clock pulse and if the value is decremented to zero, the mobile electronic device and the display panel enter the screen saver mode.

Figure 3:
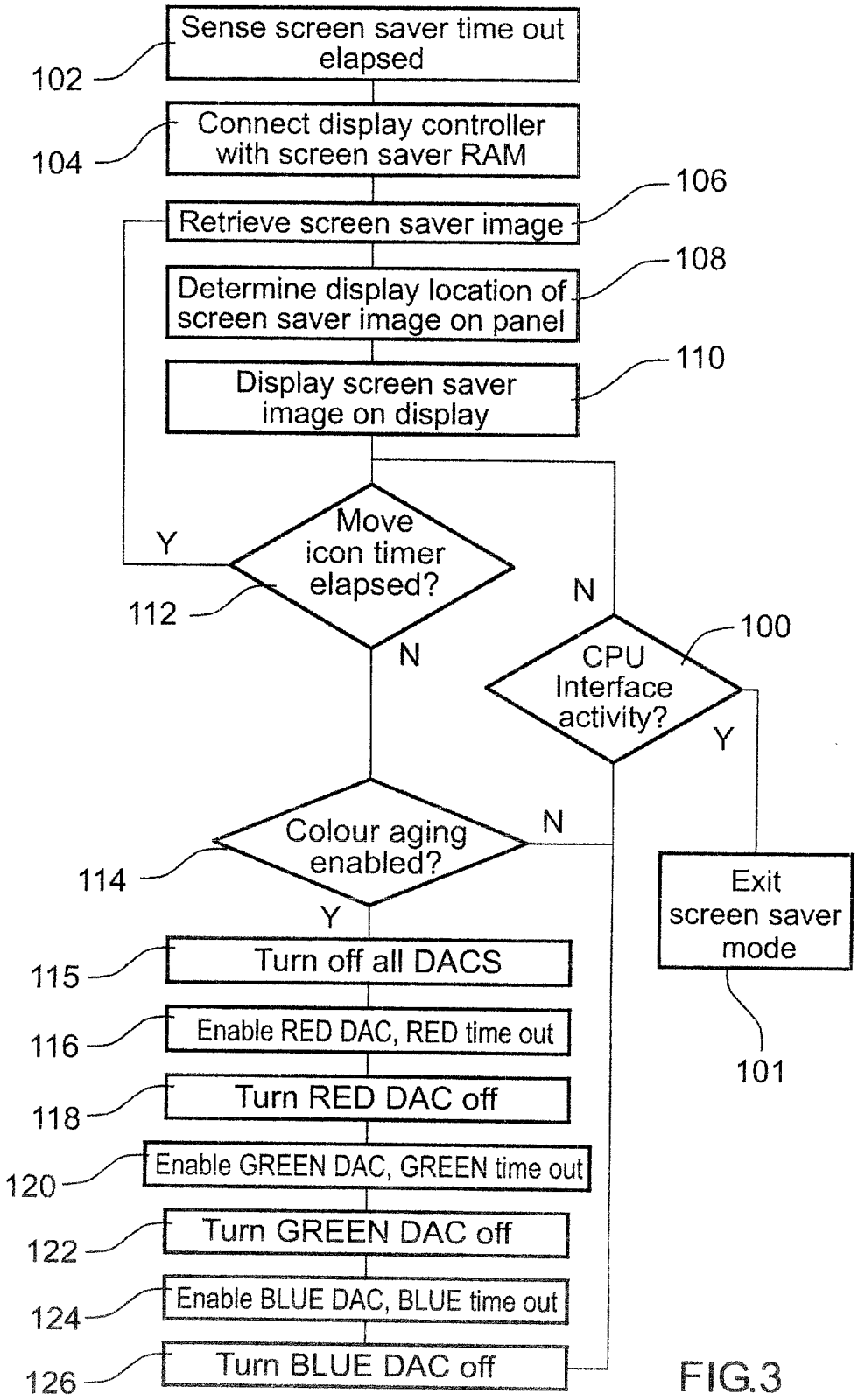
FIG. 3 is a flow diagram of a method of providing a screen saver for a mobile electronic device.

Turning to FIG. 3, a flow diagram of a method of providing a screen saver for a mobile electronic device is shown. Firstly, a check is performed to determine if there is any CPU interface activity. For example, when a WRITE line toggles, the screen saver down counter 46 is reloaded. The screen saver down counter 46 decrements with every pulse of the clock signal 50 from the CPU interface 14. As long as the screen saver down counter 46 has not reached zero and CPU activity is sensed, the mobile electronic device remains in mode 1. When the screen saver down counter 46 reaches zero, it is detected at step 102 that the screen saver time out has elapsed. In this event, there has not been any activity on the CPU interface during the allotted time period and the screen saver down counter 46 has not been reloaded, indicating a need to change from the operating mode to the screen saver mode. The screen saver down counter 46 then sends a signal via its zero output 58*d* to the MUX 26 to switch the connection for the display controller 20 from the display RAM 16 to the screen saver RAM 18 so that the display controller 20 retrieves the image data from the screen saver RAM 18 (step 104). The signal from the zero output 58*d* is also transmitted to the command generator 53 to generate its two commands.

In mode 2, the image on the display 34 is preferably black, or not powered except for the small image area. The image data is stored in the screen saver RAM 18. The image data is retrieved from the screen saver RAM 18 (step 106) by the display controller 20 and the display location for the screen saver image is also determined by the display controller 20 (step 108) via the command generator 53 and displayed on the panel 34 (step 110) as described above with respect to the display RAM 16. The displayed location of the screen saver image is not fixed and randomly (or in accordance with predefined movements) moves around the panel as defined by the command generator 53 and the move icon down counter 48. The movement of the screen saver image allows the primary colours of the OLED panel 34 to age uniformly. In addition to the screen saver image moving, in a preferred embodiment, the colour of the screen saver image changes at a rate defined by the RGB timers 35. These timers 35 are programmed to match the life of the three primary colours of the OLED panel.

Once the move icon down counter 48 is enabled, the start address of the screen saver image changes every time the move icon down counter 48 reaches zero. The counter is initially set by the input 90 from the host CPU 12 via the CPU interface 14 and decremented with each clock pulse when the mobile electronic device and display panel are in the screen saver mode. When the move icon down counter 48 reaches zero, the move icon timer has elapsed (step 112), and a signal is transmitted from the zero output 58*e* of the move icon down counter 48 to the command generator 53 which generates a new address for the image to be displayed on the OLED panel 34. This new address is then transmitted to the display controller 20 and the screen saver image is retrieved (step 106). If the move icon timer has not elapsed, a check is performed to verify that the colour aging is enabled (step 114). If not, a check is then performed to verify CPU interface activity (step 100). In the absence of interface activity, steps 112, 106-110 if necessary, and 114 are repeated. Where interface activity is detected, screen saver mode is exited, as shown at 101.

If colour aging is enabled, all the DACS are turned off (step 115) until the RED, GREEN and BLUE down counters 38, 42, and 45 are loaded and enabled. The RED, GREEN and BLUE down counters 38, 42, and 45 are then used to control the relative aging factor for these panel colours. In a preferred embodiment, the RED DAC and the RED counter 38 are enabled (step 116) by inputs 70 and 90 from the host CPU and the ORing of the zero signal 58*d* from the screen saver down counter 46 and the zero signal 58*c* from the BLUE down counter 45. When the RED down counter 38 reaches zero, a signal from its zero output 58*a* is transmitted to an AND gate along with the input 70 from the CPU interface 14 and the signal from the zero output 58*d* of the screen saver down counter 46, and the RED DAC disable signal 62 disables the RED DAC (step 118). The signal from the zero output 58*a* is also transmitted to the enable input 56*b* of the GREEN down counter 42 to enable the GREEN DAC and the GREEN timer (step 120). When the GREEN down counter 42 decrements to zero, a signal from its zero output 58*b* is transmitted to an AND gate along with the input 70 from the CPU interface 14 and the signal from the zero output of the screen saver down counter 46, and the GREEN DAC disable signal 64 disables the GREEN DAC (step 122). The signal from the zero output 58*b* is also transmitted to the enable input 56*b* of the BLUE down counter 45 to enable the BLUE DAC and the BLUE timer (step 124). Once the BLUE down counter decrements to zero, a signal from its zero output 58*c* is transmitted to an AND gate along with the input 70 from the CPU interface 14 and the signal from the zero output of the screen saver down counter 46, and the BLUE DAC disable signal 66 disables the BLUE DAC (step 126). The signal from the zero output 58*c* is also transmitted to the OR gate and coupled with the signal from the zero output 58*d* of the screen saver down counter 46. The result of this ORing is then transmitted to the load input 54*a* of the RED down counter 38. This process continues until the CPU interface re-loads the screen saver down counter 46 via the load signal 54*d*, which results in the screen saver down counter 46 and the zero output 58*d* being asserted, which enables all three DACs.

As will be understood, there are many different implementations and methods for driving an OLED panel 34. Other OLED drivers may use external RAM or have a common and segment IC as a separate component. Furthermore, in other embodiments, the screen saver controller may be included within the display controller 20.

It will also be understood that although step 100 is shown as a separate step that follows other steps in the method shown in FIG. 3, interface activity preferably interrupts a screen saver mode, such that screen save mode is exited upon detection of activity.

In another embodiment of the invention, data, such as the time data, system status data or the number of unread email data, may be displayed in the screen saver image The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A screen saver system in a mobile electronic device comprising:

memory for storing a screen saver image;

display controlling apparatus (DCA) configured to retrieve said screen saver image from said memory and to transmit said screen saver image to a display panel, said display panel having a set of red, green, blue (RGB) colors;

a screen saver controlling apparatus (SSCA) comprising a central processing unit (CPU) interface designed to interface with a CPU within the mobile electronic device to receive display data, the CPU interface further designed to interface with a plurality of timers, where each of said plurality of timers is associated with one of said set of RGB colors, and further where said timers are operably disposed in said SSCA such that each timer counts a determined amount of time that each RGB color is to be used while said screen saver image is being displayed, and wherein said SSCA and said DCA are further configured such that said determined amount of time that each RGB color is to be used to individually set one RGB color to one of on or off, independent of whether the other RGB colors are individually on or off, to balance life across the set of RGB colors.

2. The system of claim 1 wherein said display controlling apparatus comprises:

a display controller;

a segment driver; and a common driver.

3. The system of claim 1 wherein said screen saver controlling apparatus further comprises:

a move icon timer configured to determine a move icon time; and a command generator configured to generating a new display location for said screen saver image using said determined move icon time.

4. The system of claim 1 wherein said screen saver image comprises at least one of time data, system status data or number of un-read email data.

5. A method of providing a screen saver for a display panel in a mobile electronic device comprising:

receiving display image data from a central processing unit (CPU) of the mobile device through a CPU interface;

displaying a screen saver image on said display panel, said display panel having a plurality of red, green, blue (RGB) colors, said screen saver image comprising use of at least one of said set of RGB colors;

using a timer to count a determined amount of time that one of said RGB colors currently in use on said display panel is to be turned on while said screen saver image is displayed, the timer associated with the one RGB color;

turning off said RGB color on said display panel when the time has counted down the determined amount of time; and wherein each RGB color has a timer associated with it, and, is controllable for turning on or off, independently of whether the other RGB colors are individually on or off, based on input from the associated timer to balance life across the set of RGB colors.

6. The method of claim 5 comprising:

displaying said screen saver image on only a portion of said display panel;

moving said screen saver image from one portion of said display panel to another portion of said display panel, based on a move icon timer and a newly determined display location.

7. The method of claim 5 wherein said screen saver image comprises at least one of time data, system status data or number of un-read email data.

* * * * *